United States Patent [19]

Nycz et al.

[11] Patent Number: 4,821,899

[45] Date of Patent: Apr. 18, 1989

[54] DISPENSING CLOSURE

[75] Inventors: Joseph D. Nycz, Haskins; Mark J. Schoenlein, Perrysburg, both of Ohio

[73] Assignee: Owens-Illinois Closure Inc., Toledo, Ohio

[21] Appl. No.: 211,186

[22] Filed: Jun. 24, 1988

[51] Int. Cl.[4] ..... B65D 47/00

[52] U.S. Cl. ..... 215/235; 220/335; 220/338; 222/556

[58] Field of Search ..... 215/235, 237; 220/335, 220/338; 222/556, 498

[56] References Cited

U.S. PATENT DOCUMENTS

| | | | |
|---|---|---|---|
| 3,323,671 | 6/1967 | Minarik | 215/237 |
| 4,441,637 | 4/1984 | Libit | 215/235 X |
| 4,533,058 | 8/1985 | Uhlig | 215/235 X |

*Primary Examiner*—Donald F. Norton

[57] ABSTRACT

A dispensing closure for attachment to the finish of a bottle to selectively permit or prevent the dispensing of a flowable product in the bottle through an opening in the closure. The closure is made up of a molded plastic, cup-shaped base cap member, the dispensing opening being in a top of such base cap member, and a molded plastic generally planar closing member an end of which is pivotally received in a depressed socket portion of the base cap member. The closing member carries a plug which is engaged in the dispensing opening of the base cap member when the closing member is in a first position relative to the base cap member, and the plug is out of engagement with the dispensing opening when the closing member has been pivoted with respect to the base cap member from the first position to a second position. The end of the closing member which is received in the depressed socket portion of the base cap member is reinforced to prevent it from popping out of the depressed socket portion as the closing member is pivoted from the second position back to the first position.

29 Claims, 3 Drawing Sheets

DISPENSING CLOSURE

BACKGROUND OF THE INVENTION

1. Field Of The Invention

This invention relates to a dispensing closure which is adapted to be affixed to the exterior of the neck or finish portion of a bottle. More particularly, this invention relates to a dispensing closure which includes a base cap with an opening therein and a pivotable closing member an end of which is pivotably received in a socket portion of the base cap and which is pivotable about an axis extending through such end between a first, closing position in which it closes the opening in the base cap and a second, dispensing position in which the opening in the base cap is open for product dispensing.

2. Description Of The Prior Art

As is known in the prior art, many types of dispensing closures have been developed for use with bottles to permit the dispensing of the contents of each such bottle through an opening in a closure which is attached to the bottle without the need for removing the closure from the bottle, while also providing for proper, non-dispensing closing of the bottle by a proper manipulation of an element of the closure, while the closure is still on the bottle. See, for example, U.S. Pat. No. 4,533,058 (A. P. Uhlig) for a type of dispensing closure which is known in the prior art.

Another type of dispensing closure which is known in the prior art is the so-called turret type, a version of which is illustrated in U.S. Pat. No. 4,441,637 (S.M. Libit). A dispensing closure of this type is provided with a base cap, which is usually manufactured from a thermoplastic material and which is adapted to be affixed to the exterior of a bottle, usually by a threaded connection therebetween, and is further provided with a closure member which is pivotably frictionally received in a socket in the base cap and which, when it is in an upright position, uncovers an opening in the base cap for dispensing of the contents of the container through such opening. When the closure member is pivoted away from its upright, dispensing position to a reclined, horizontal position, usually within a recess of the base cap, a plug portion carried by such closure member closes the opening in the base cap and effectively closes the package that includes such dispensing closure. However, certain problems have risen with respect to dispensing closures of the type shown in the aforesaid U.S. Pat. No. 4,441,637 with respect to the closure member popping out of the socket of the base cap, since the plug portion carried by the closure member acts as the fulcrum of the closure member when it enters into the opening in the base cap, thus imposing rather high leverage loadings on the connection between the socket portion of the base cap and the end portion of the closure member that is pivotably received therein.

SUMMARY OF THE INVENTION

According to the present invention, there is provided a turret-type dispensing closure which has improved resistance to disengagement between a base cap member thereof and a closure member thereof in the form of a elongate member, an end of which is pivotably received and frictionally engaged in a socket portion of the base cap, especially when the closure member is pivoted with respect to the base cap and a plug portion carried by the closure member enters an opening in the base cap. At such time, the plug portion of the closure member tends to act as a fulcrum for the closure member, thus imposing leverage loads on the end of the closure member that is received in the socket portion of the cap, and in the present invention, the connection between the socket and the end of the closure which is received therein is substantially reinforced to resist these leverage loads and to thereby prevent disengagement of the closure member from the base cap member during the closing of the dispensing closure.

Accordingly, it is an object of the present invention to provide an improved dispensing closure, and it is a corollary object to provide a package which includes such an improved dispensing closure. More particularly, it is an object of the present invention to provide an improved dispensing closure of the turret type, and it is a corollary object to provide a package which includes such an improved turret-type dispensing closure. Even more particularly, it is an object of the present invention to provide a dispensing closure of the foregoing type with improved resistance to disengagement of a closing member from a base cap, a socket portion of which pivotably receives and frictionally retains an end of the closure member, and it is a corollary object to provide a package which includes such a dispensing closure.

For a further understanding of the present invention and the objects thereof, attention is directed to the drawing and the following brief description thereof, to the detailed description of the preferred embodiment, and to the appended claims.

DETAILED DESCRIPTION OF THE PREFERRED EMBODIMENT

Figure 1:
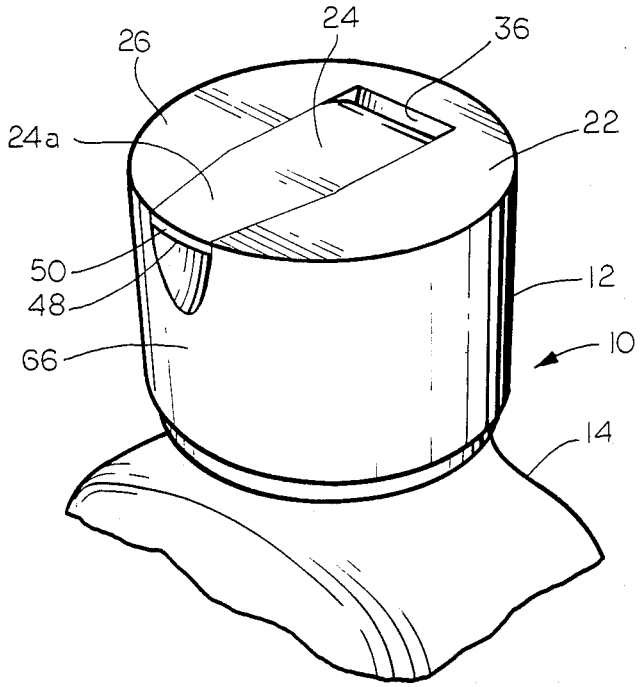
FIG. 1 is a fragmentary perspective view of a package which incorporates a dispensing closure according to a preferred embodiment of the present invention in assembled relationship to a bottle, the package being shown in its closed, non-dispensing condition.
Figure 3:
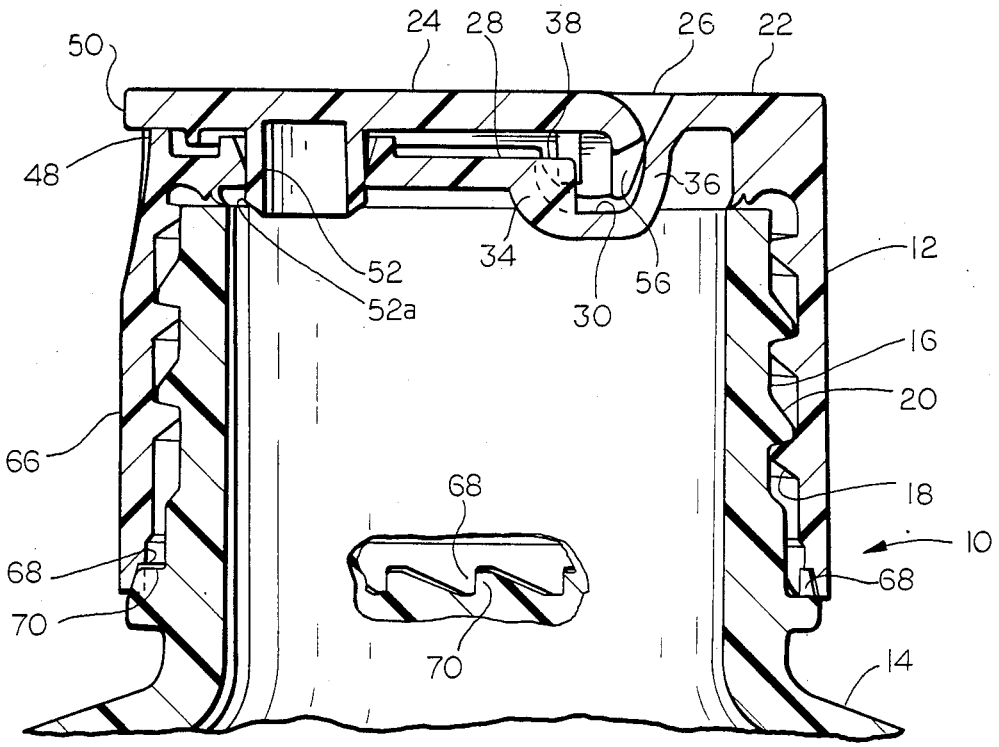
FIG. 3 is a fragmentary vertical sectional view of the package of FIG. 1, with a portion being broken away to illustrate a feature of such package.
Figure 4:
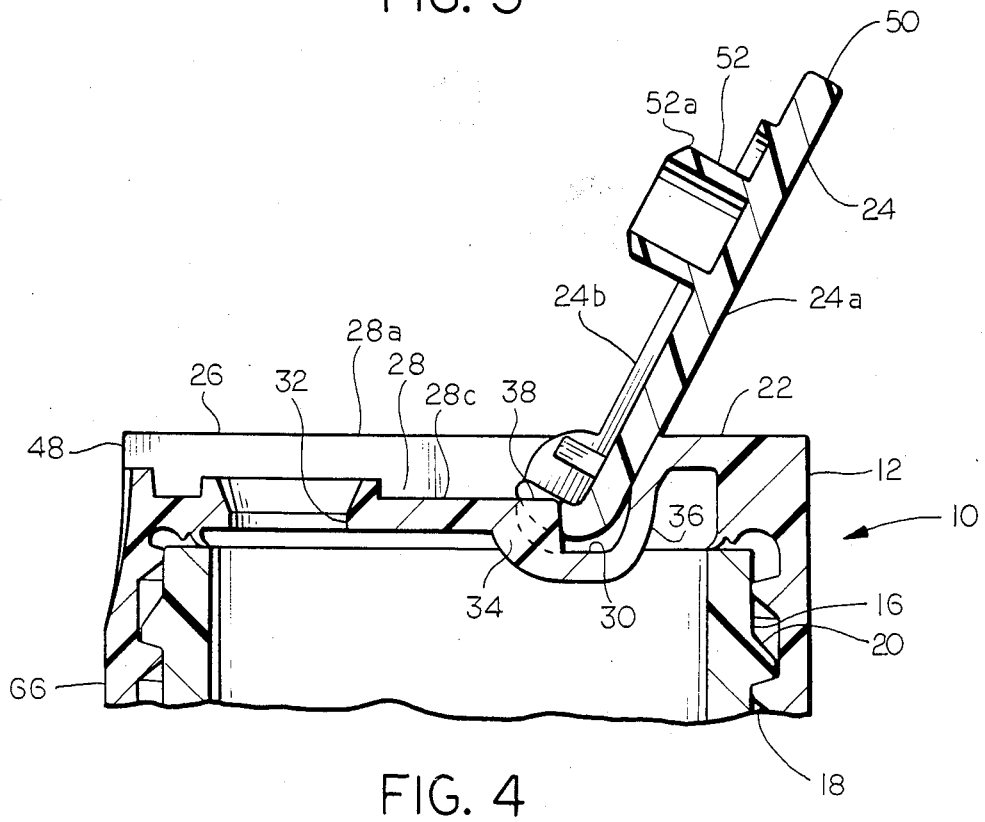
FIG. 4 is a fragmentary vertical sectional view of the package of FIG. 1 illustrating the dispensing closure thereof in the opened, dispensing condition of such dispensing closure.
Figure 5:
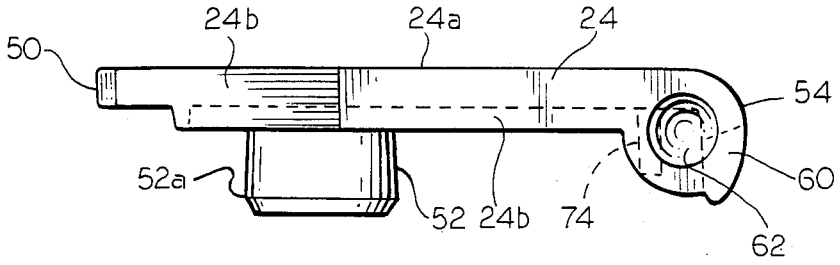
FIG. 5 is an elevational view of another component of the closure of FIGS. 1, 3 and 4.
Figure 6:
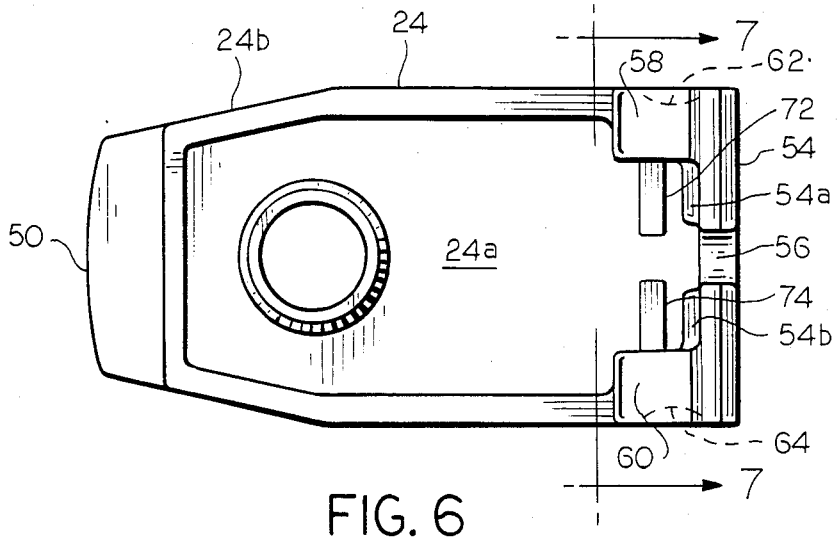
FIG. 6 is a bottom plan view of the component illustrated in FIG. 5.
Figure 7:
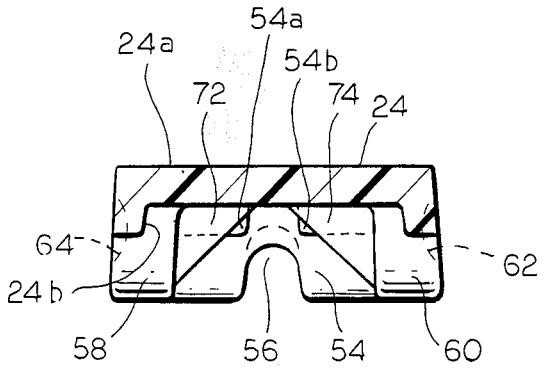
FIG. 7 is a sectional view taken on line 7—7 of FIG. 6.

As is shown in FIGS. 1, 3, and 4, a package in accordance with the present invention is indicated generally by reference numeral 10, and the package 10 is made up of a closure which is generally identified by reference numeral 12 and a bottle which is generally identified by reference numeral 14 and which is shown fragmentarily. The closure 12 is affixed to a finish portion 16 of the bottle 14 by the interengagement of an helical thread 18 on the inside of the closure and an helical thread 20 on the outside of the finish portion 16 of the bottle, as is known in the art. The bottle 14 may be a blown glass container or it may be a blow-molded plastic container, for example, a blow-molded, high density polyethylene container. The bottle 14 may, thus, be of conventional construction, and will not be further described herein.

The closure 12 includes a cup-shaped base cap member 22, which includes the helical thread 18, and an elongate, generally planar closing member 24 which is pivotally secured to the base cap member 22. The base cap member 22 is formed in the illustrated complex configuration from a suitable thermoplastic material, for example, a material whose principal ingredient is high density polyethylene or polypropylene, by injection molding, and the closing member 24 is also preferably formed from such a suitable thermoplastic material by injection molding. The base cap member 22 has an interrupted, substantially planar top surface 26 which spans the finish 16 of the bottle 14, and the interruption in the substantially planar top surface 26 of the base cap member 22 is in the form of a recessed wall portion 28 which extends radially inwardly from an edge of the substantially planar top surface 26 past the center thereof. The interior end of the recessed wall portion 28 of the base cap member 22 has sidewalls **28*a* and 28*b* which extend downwardly from the top surface 26 and a bottom wall 28*c* which extends between the sidewalls 28*a* and 28*b*, and is provided with a generally semi-cylindrical depressed socket portion 30. The recessed wall portion 28 of the base cap member 22 is further provided with a dispensing orifice 32 which extends through the bottom wall 28*c* of the recessed wall portion 28 to form a dispensing opening in the base cap member 22 and which is spaced from the depressed socket portion 30. The depressed socket portion 30 is formed with a frontwall surface 34 and a backwall surface 36, and the backwall surface 36 leads to the substantially planar top surface 26. The dispensing orifice 32, when it is in an unclosed condition, as is shown in FIG. 4, permits dispensing of a flowable product in the bottle 14 through the base cap member 22**.

Figure 2:
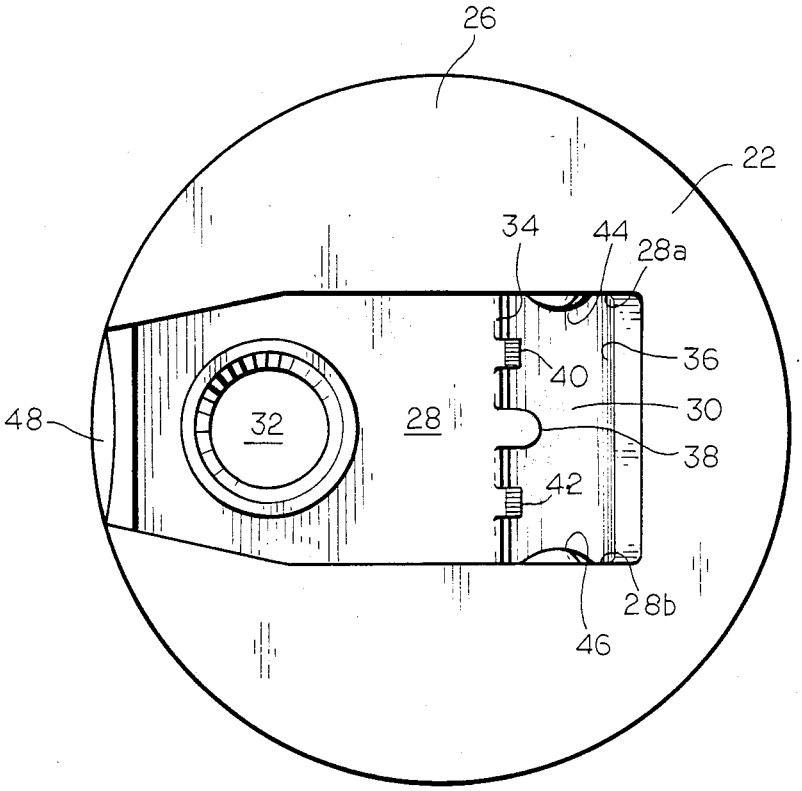
FIG. 2 is a top plan view of a component of the closure of the package of FIG. 1.

As is shown in FIGS. 2, 3, and 4, the front wall surface 34 of the depressed socket portion 30 divides the depressed socket portion 30 from the recessed wall portion 28 and is provided with an upstanding, centrally located post portion 38 and a pair of spaced apart pads 40 and 42 on opposite sides of the post portion 38. The depressed socket portion 30 is also provided with axially aligned, hemispherical projections 44 and 46 which project toward one another into the depressed socket portion 30 from the sidewalls **28*a* and 28*b*, respectively, along an axis extending between the frontwall surface 34 and the backwall surface 36**.

The closing member 24 is formed with a leading edge 50 which is accessible from a peripheral edge of the recessed wall portion 28 when the closing member 24 is in its closing position with respect to the base cap 22, as is shown in FIG. 3, to facilitate the pivoting of the closing member from the FIG. 3 closing position to its FIG. 4, dispensing position. Spaced inwardly from the leading edge 50 of the closing member 24 is a plug member 52 which, preferably, is annular in configuration and which is dimensioned and positioned along the closing member to be snugly received in the dispensing orifice 32 of the base cap member 22 when the closing member 24 is in the FIG. 3 closing position. Preferably, as shown, the inner surface of the dispensing orifice 32 of the base cap member 22 and the outer surface of the plug member 52 of the closing member 24 are bevelled to facilitate the insertion of the plug member 52 into the dispensing orifice 32 during the pivoting of the closing member 24 from the FIG. 4 dispensing position to the FIG. 3 closing position, a function which is also facilitated by the annular configuration of the plug member 52. Further, the plug member 52 has a maximum diameter portion **52*a* spaced from, but near, the free end thereof between a downwardly and inwardly tapered or beveled portion, which tapers at approximately a 30° angle, leading to the free end and an upwardly and inwardly tapered portion above the portion 52*a*, which tapers at an angle of approximately 1°. The maximum diameter portion make it possible for the plug member 52 to securely engage the inside of the dispensing orifice 32 with high unit loadings between the maximum diameter portion 52*a* and the orifice 32 for good sealing without creating excessive forces resisting the insertion of the plug member 52 into the dispensing orifice 32 or the removal of the plug member 52 from the dispensing orifice 32**.

The closing member 24 has a generally planar portion **24*a* which is stiffened by a generally perimetrical flange 24*b* that depends from the underside of the edge of the planar portion 24*a*, and the closing member 24 is also provided with an interrupted turned down flange portion 54 at a trailing end of the closing member 24 which is opposite its leading edge 50. The interruption in the flange portion 54 is a single, centrally located interruption 56 which extends from the bottom edge of the flange portion 54 only partially to the top thereof and which engages the upstanding post portion 38 of the base cap member in a tight fit when the closing member 24 is in the FIG. 4 dispensing position to assist in frictionally retaining the closing member 24 in such position. Further, the free edge of flange portion 54 of the closing member 24 engages the pads 40 and 42 of the base cap member 22 when the closing member 24 is pivoted from the FIG. 3 closing position to the FIG. 4 dispensing position to provide an over center effect before the closing member 24 reaches the FIG. 4 dispensing position to further assist in frictionally retaining the closing member 24 in its FIG. 4 dispensing position. The closing member 24 also has side surfaces 58 and 60 extending from the flange portion 54 partly toward the leading edge 50. The side surfaces 58 and 60 have axially aligned hemispherical recesses 62 and 64, respectively, therein, and the recesses 62 and 64, respectively, receive the projections 44 and 46 of the base cap member 22 in a snap fit which permits pivoting movement of the closing member 24 with respect to the base cap member 22 along the axis is which extends through the projections 44 and 46 and the recesses 62 and 64. Thus, to provide such a snap fit, the outside to outside spacing between the side surfaces 58 and 60 of the closing member 24 is greater than the inside to inside spacing between the projections 44 and 46 of the base cap member 22**.

To provide maximum resistance to accidental removal of the closure 12 from the bottle 14, the inside of a skirt 66 of the base cap member 22 of the closure 12 is provided with a circumferential series of inwardly projecting ratchet teeth 68 which engage a corresponding circumferential series of outwardly projecting ratchet teeth 70 on the finish of the bottle 14 as is seen, for example, in FIG. 3. By virtue of the use of such series of ratchet teeth, which are inclined in the direction of the application of the closure 12 on the finish of the bottle 14, considerably more torque is required to remove the closure than to apply it, and this inhibits accidental removal of the closure by a child or otherwise. Such resistance to accidental removal of the closure can also be obtained without the illustrated ratchet teeth by bonding or adhering the closure to the container by the use of a suitable adhesive or by ultrasonically or heat sealing it thereto, in a known manner.

Upon the pivoting movement of the closing member 24 from its FIG. 4 dispensing position to its FIG. 3 closing position, some resistance to such pivoting movement will be encounted as the plug member 52 of the closing member 24 begins to enter the dispensing orifice 32 of the base cap member 22, thus imposing leverage loads on the fit between the projections 44 and 46 of the base cap member 22 and the recesses 62 and 64 which, respectively, pivotally receive such projections. Because of the elasticity of the thermoplastic materials which are used in the manufacture of the base cap member 22 and the closing member 24, these loads tend to pop the end of the closing member 24 which is received in the depressed socket portion 38 of the base cap member 22 out of such socket portion 38, and this is a problem which was encountered in connection with the operation of dispensing closures of the type illustrated in the aforesaid U.S. Pat. No. 4,441,637. In the present invention, this problem is overcome by reinforcing the side surfaces 58 and 60 against inward deflection by inwardly projecting triangular gussets 72 and 74, respectively, which extend between the insides of the side surfaces 58 and 60 and the underside of the planar portion of the closing member 24; and by providing the flange portion 54 of the base closing member 24 with reduced depth, thickened portions **54*a* and 54*b*, extending downwardly from the underside of the generally planar portion 24*a* and inwardly from the side surfaces 58 and 60, respectively thereof. There is sufficient spacing between the innermost ends of the thickened portions 54*a* and 54*b* to permit proper engagement of the upstanding post portion 38 of the base cap 22 by the interruption 56 in the flange 54 of the closing member 24 as the closing member 24 is pivoted from its FIG. 3 closing position to its FIG. 4 dispensing position, and the vertical extent of the thickened portions 54*a* and 54*b* is limited so that the bottom edge of the flange portion 54 of the closing member 24 will have sufficient flexibility to properly deflect when it engages the pads 40 and 42 of the base cap member 22 as the closing member 24 is pivoted from the FIG. 3 closing position to the FIG. 4** dispensing position.

Although the best mode contemplated by the inventors for carrying out the present invention as of the filing date hereof has been shown and described herein, it will be apparent to those skilled in the art that suitable modifications, variations and equivalents may be made without departing from the scope of the invention, such scope being limited solely by the terms of the following claims.

What is claimed is:

1. A dispensing closure for a bottle that contains a flowable product, the bottle having an annular closure receiving finish, said closure comprising;

a cup-shaped base cap member having an annular skirt with bottle finish engaging means, said annular skirt being adapted to surround and engage the finish of the bottle, said base cap member further having an interrupted generally planar top positioned within an annulus defined by said annular skirt, a recessed wall portion in an interruption in said generally planar top, said recessed wall portion extending inwardly from an edge of said top past a center thereof to an end, said recessed wall portion having a depressed socket portion at said end thereof and a dispensing opening which is away from said depressed socket portion and which extends through said base cap member, whereby the flowable product can be dispensed from the bottle through said dispensing opening; and a closing member having a generally planar portion with a first end, a second end, and a flange extending generally normally to said generally planar portion from one of said first end and said second end, said flange having a free edge, said closing member further having spaced apart first and second side surfaces extending normally from said flange partly toward the other of said first end and said second end and a plug which extends from said generally planar portion and which is spaced between said first end and said second end, said one of said first end and said second end of said closing member being received in said depressed socket portion of said base cap member, said closing member being pivotable with respect to said base cap member about a pivot axis between a first position in which said closing member is engaged in said recessed wall portion of said base cap member with said plug being received in said dispensing opening in said base cap member to prevent the flowable product from being dispensed through said dispensing opening and a second position in which said closing member extends away from said base cap member and said plug is away from said dispensing opening to permit the flowable product in the bottle be dispensed through said dispensing opening;

one of said base cap member and said closing member being provided with projection means, the other of said base cap member and said closing member being provided with recess means, said recess means frictionally engaging said projection means along said pivot axis, said pivot axis extending through said projection means and said recess means;

said flange of said closing member further having thickened portion means extending from said generally planar portion partly to said free end, and further extending from at least one of said first surface and said second surface, said thickened portion means stiffening said one of said first end and said second end of said closing member to prevent said closing member from being disengaged from said base cap member as said closing member is being pivoted about said pivot axis from said second portion to said first position.

2. A dispensing closure according to claim 1 wherein said cup-shaped base cap member is formed integrally in a single piece from a thermoplastic material and wherein said closing member is formed integrally in a second single piece from a second thermoplastic material.

3. A dispensing closure according to claim 2 wherein each of said thermoplastic material and said second thermoplastic material comprises, as its principal ingredient, a material selected from the group consisting of high density polyethylene and polypropylene.

4. A dispensing closure according to claim 3 wherein each of said cup-shaped base cap member and said closing member is formed by injection molding.

5. A dispensing closure according to claim 1 wherein said closing member also has gusset means spaced from said flange and extending between said generally planar portion and one of said first side surface and said second side surface toward the other of said first side surface and said second side surface, said gusset means further stiffening said one of said first end and said second end of said closing member as said closing member is being pivoted about said pivot axis from said first position to said second position.

6. A dispensing closure according to claim 5 wherein said gusset means of said closing member comprises a first gusset extending between said generally planar portion and said one of said first side surface and said second side surface and a second gusset extending between said generally planar portion and the other of said first side surface and said second side surface.

7. A dispensing closure according to claim 1 wherein said recessed wall portion of said base cap member has a front wall surface which extends generally normally to said top surface of said base cap member and which separates said depressed socket portion of said recessed wall portion from another portion of said recessed wall portion, said front wall surface having pad means extending into said depressed socket portion, and wherein said free edge of said flange of said closing member engages and is deflected by said pad means of said front wall surface of said base cap member as said closing member is pivoting with respect to said base cap member from said first position to said second position to provide an over center effect.

8. A dispensing closure according to claim 7 wherein said pad means comprises first and second spaced apart pads.

9. A dispensing closure according to claim 7 wherein said front wall surface of said base cap member further has an upstanding post portion which extends from said front wall surface into said depressed socket portion, said upstanding post portion being spaced from said pad means, and wherein said flange of said closing member has an interruption extending at least partly from said free end to said generally planar portion, said interruption in said flange frictionally engaging said upstanding post portion as said closing member is being moved from said second position to said first position.

10. A dispensing closure according to claim 1 wherein said plug of said closing member is annular in configuration.

11. A dispensing closure according to claim 10 wherein said plug of said closing member has an outer beveled surface and wherein said dispensing opening of said base cap member has an inner beveled surface to facilitate the insertion of said plug into said dispensing opening as said closing member is pivoted from said second position to said first position.

12. A dispensing closure according to claim 10 wherein said plug has a free end and a maximum diameter portion spaced inwardly from said free end between said free end and said generally planar portion, said plug tapering inwardly from said maximum diameter portion as it extends toward said generally planar portion.

13. A dispensing closure according to claim 1 wherein said base cap member is provided with said projection means and said closing member is provided with said recess means.

14. A dispensing closure according to claim 1 wherein said projection means comprises a first inwardly facing projection and a second inwardly facing projection, and wherein said recess means comprises a first outwardly facing recess and a second outwardly facing recess, one of said first projection and said second projection being frictionally engaged in one of said first recess and said second recess, the other of said first projection and said second projection being frictionally engaged in the other of said first recess and said second recess.

15. A package comprising:

a bottle having an annular finish and closure engaging means on said annular finish, said bottle being adapted to contain a flowable product; and a dispensing closure having bottle finish engaging means, said dispensing closure being affixed to said bottle with said bottle finish engaging means of said dispensing closure in engagement with said closure engaging means of said bottle and comprising;

a cup-shaped base cap member having an annular skirt said bottle finish engaging means being attached to said annular skirt, said base cap member further having an interrupted generally planar top positioned within an annulus defined by said annular skirt, a recessed wall portion in an interruption in said generally planar top, said recessed wall portion extending inwardly from an edge of said top surface past a center thereof to an end, said recessed wall portion having a depressed socket portion at said end thereof and a dispensing opening which is away from said depressed socket portion and which extends through said base cap member, whereby the flowable product can be dispensed from said bottle through said dispensing opening; and a closing member having a generally planar portion with a first end, a second end, and a flange extending generally normally to said generally planar portion from one of said first end and said second end, said flange having a free edge, said closing member further having spaced apart first and second side surfaces extending normally from said flange partly toward the other of said first end and said second end and a plug which extends from said generally planar portion and which is spaced between said first end and said second end, said one of said first end and said second end of said closing member being received in said depressed socket portion of said base cap member, said closing member being pivotable with respect to said base cap member about a pivot axis between a first position in which said closing member is engaged in said recessed wall portion of said base cap member with said plug being received in said dispensing opening in said base cap member to prevent the flowable product from being dispensed through said dispensing opening and a second position in which said closing member extends away from said base cap member and said plug is away from said dispensing opening to permit the flowable product in said bottle to be dispensed through said dispensing opening;

one of said base cap member and said closing member being provided with projection means, the other of said base cap member and said closing member being provided with recess means, said recess means frictionally engaging said projection means along said pivot axis, said pivot axis extending through said projection means and said recess means;

said flange of said closing member further having thickened portion means extending from said generally planar portion partly to said free end, and further extending from at least one of said first surface and said second surface, said thickened portion means stiffening said one of said first end and said second end of said closing member to prevent said closing member from being disengaged from said base cap member as said closing member is being pivoted about said pivot axis from said second position to said first position.

16. A package according to claim 15 wherein said cup-shaped base cap member of said dispensing closure is formed integrally in a single piece from a thermoplastic material and wherein said closing member of said dispensing closure is formed integrally in a second single piece from a second thermoplastic material.

17. A package 16 according to claim 16 wherein each of said thermoplastic material and said second thermoplastic material comprises, as its principal ingredient, a material selected from the group consisting of high density polyethylene and polypropylene.

18. A package according to claim 17 wherein each of said cup-shaped base cap member and said closing member is formed by injection molding.

19. A package according to claim 15 wherein said closing member of said dispensing closure also has gusset means spaced apart from said flange and extending between said generally planar portion and one of said first side surface and said second side surface toward the other of said first side surface and said second side surface, said gusset means further stiffening said one of said first end and said second end of said closing member as said closing member is being pivoted about said pivot axis from said first position to said second position.

20. A package according to claim 19 wherein said gusset means of said closing member comprises a first gusset extending between said generally planar portion and said one of said first side surface and said second side surface and a second gusset extending between said generally planar portion and the other of said first side surface and said second second side surface.

21. A package according to claim 15 wherein said recessed wall portion of said base cap member of said dispensing closure has a front wall surface which extends generally normally to said top surface of said base cap member and which separates said depressed socket portion of said recessed wall portion from another portion of said recessed wall portion, said front wall surface having pad means extending into said depressed socket portion, and wherein said free edge of said flange of said closing member engages and is deflected by said pad means of said front wall surface of said base cap member as said closing member is pivoting with respect to said base cap member from said first position to said second position to provide an over center effect.

22. A package according to claim 21 wherein said pad means of said base cap member of said dispensing closure comprises first and second spaced apart pads.

23. A package according to claim 21 wherein said front wall surface of said base cap member of said dispensing closure further has an upstanding post portion which extends from said front wall surface into said depressed socket portion, said upstanding post portion being spaced from said pad means, and wherein said flange of said closing member further has an interruption extending at least partly from said free end to said generally planar portion, said interruption in said flange frictionally engaging said upstanding post portion as said closing member is being moved from said second position to said first position.

24. A package according to claim 15 wherein said plug of said closing member of said dispensing closure is annular in configuration.

25. A package according to claim 24 wherein said plug of said closing member of said dispensing closure has an outer beveled surface and wherein said dispensing opening of said base cap member of said dispensing closure has an inner beveled surface to facilitate the insertion of said plug into said dispensing opening as said closing member is pivoted from said second position to said first position.

26. A dispensing closure according to claim 24 wherein said plug has a free end and a maximum diameter portion spaced inwardly from said free end between said free end and said generally planar portion, said plug tapering inwardly from said maximum diameter portion as it extends toward said generally planar portion.

27. A package according to claim 15 wherein said base cap member is provided with said projection means and said closing member of said dispensing closure is provided with said recess means.

28. A package according to claim 15 wherein said projection means of said dispensing closure comprises a first inwardly facing projection and a second inwardly facing projection, and wherein said recess means comprises a first outwardly facing recess and a second outwardly facing recess, one of said first projection and said second projection being frictionally engaged in one of said first recess and said second recess, the other of said first projection and said second projection being frictionally engaged in the other of said first recess and said second recess.

29. A package according to claim 15 wherein said closure engaging means on said annular finish of said bottle comprises helical thread means, wherein said bottle finish engaging means of said dispensing closure comprises second helical thread means, said closure be applied to said bottle by turning in a first direction and being removable from said bottle by turning in a second direction which is opposed to said first direction, said annular finish of said bottle further having a circumferential series of outwardly projecting ratchet teeth which are inclined in said first direction, said annular skirt of said base cap member of said dispensing closure further having a circumferential series of inwardly projecting ratchet teeth which are inclined in said first direction, said circumferential series of inwardly projecting ratchet teeth engaging said circumferential series of outwardly projecting ratchet teeth when said dispensing closure is affixed to said bottle, whereby the torque required to remove said dispensing closure from said bottle is considerably higher than the torque required to apply said dispensing closure to said bottle.

* * * * *